United States Patent [19]

Feldman et al.

[11] Patent Number: 4,773,986

[45] Date of Patent: Sep. 27, 1988

[54] HIGH SEVERITY VISBREAKING

[75] Inventors: Robert J. Feldman, Passaic; Andrei Rhoe, Wyckoff; Roger P. Van Driesen, Titusville; Joseph F. Puzio, Park Ridge; Vincent A. Strangio, Glen Ridge, all of N.J.

[73] Assignee: Lummus Crest, Inc., Bloomfield, N.J.

[21] Appl. No.: 943,174

[22] Filed: Dec. 18, 1986

[51] Int. Cl.[4] ..... C10G 55/04

[52] U.S. Cl. ..... 208/96; 208/95; 208/97; 208/106; 208/177

[58] Field of Search ..... 208/106, 95, 96, 97, 208/177; 210/723, 729, 737

[56] References Cited

U.S. PATENT DOCUMENTS

| | | | |
|---|---|---|---|
| 3,365,384 | 1/1968 | Pasternak | 208/106 |
| 3,684,685 | 8/1972 | Herbstman et al. | 208/106 |
| 4,178,228 | 12/1979 | Chang | 208/106 |
| 4,277,324 | 7/1981 | Greenwood | 208/96 |
| 4,389,302 | 6/1983 | Garwin et al. | 208/106 |
| 4,454,023 | 6/1984 | Lutz | 208/96 |
| 4,470,900 | 9/1984 | Kydd | 208/177 |
| 4,481,101 | 11/1984 | Yan | 208/106 |
| 4,508,614 | 4/1985 | Yan | 208/106 |
| 4,530,755 | 7/1985 | Ritchie et al. | 208/96 |
| 4,604,188 | 8/1986 | Yan et al. | 208/106 |
| 4,615,791 | 10/1986 | Choi et al. | 208/106 |
| 4,657,665 | 4/1987 | Beaton et al. | 208/59 |

*Primary Examiner*—Anthony McFarlane

*Attorney, Agent, or Firm*—Elliot M. Olstein; John N. Bain; John G. Gilfillan

[57] ABSTRACT

The severity of a visbreaking operation is increased by treating product to remove a heavier phase in an amount of less than 15 weight percent and provide a remaining product having a Shell Hot Filtration number of less than 0.25.

22 Claims, 1 Drawing Sheet

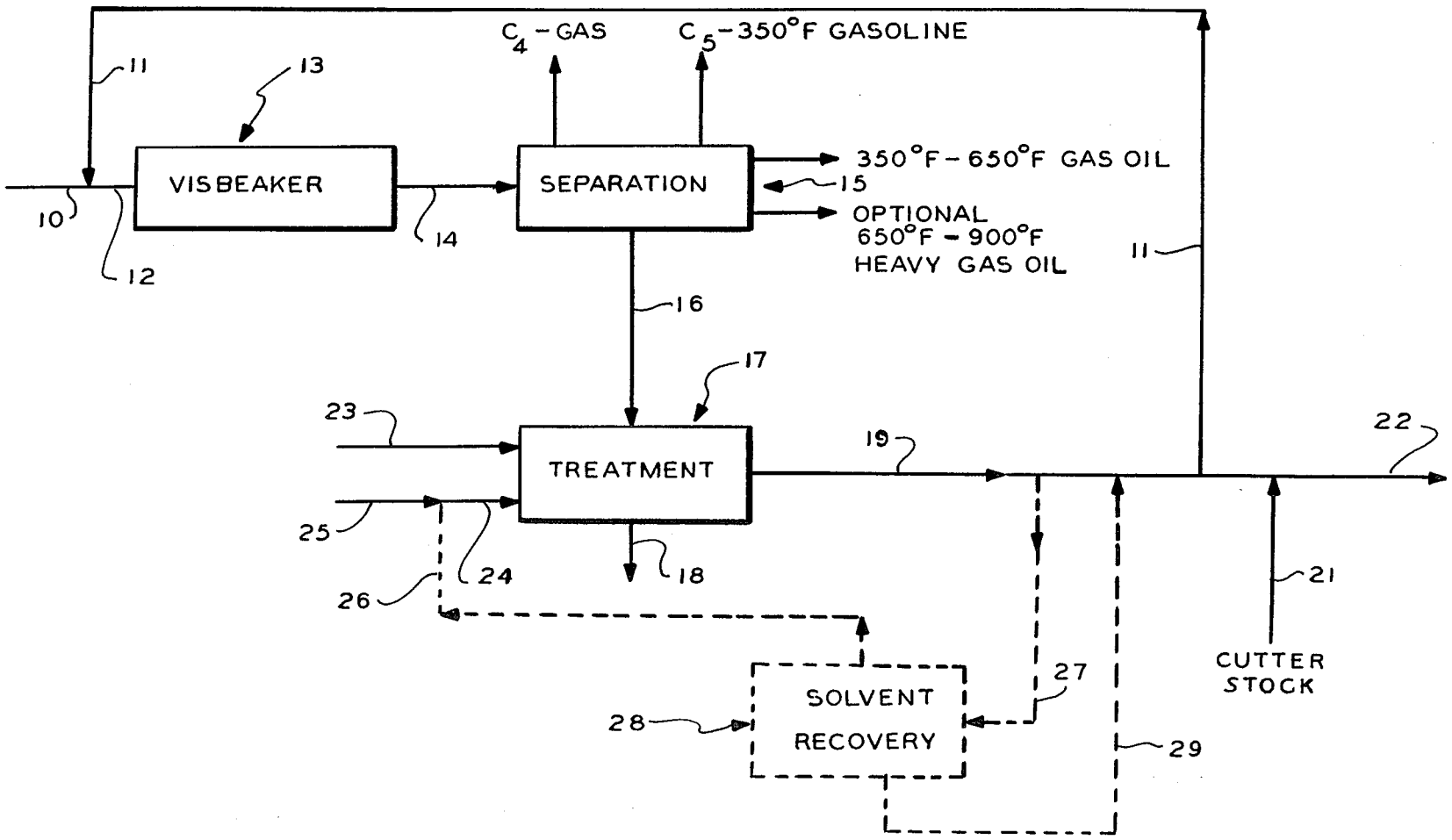
VISBEAKER
SEPARATION
TREATMENT
SOLVENT RECOVERY
CUTTER STOCK
$C_4$ - GAS
$C_5$ - 350°F GASOLINE
350°F - 650°F GAS OIL
OPTIONAL 650°F - 900°F HEAVY GAS OIL
10
11
12
13
14
15
16
17
18
19
21
22
23
24
25
26
27
28
29

HIGH SEVERITY VISBREAKING

This invention relates to upgrading of feeds by visbreaking, and more particularly, to a process for increasing the severity of a visbreaking operation.

Feeds from a wide variety of sources have been subjected to visbreaking (both thermal visbreaking and hydrovisbreaking) to upgrade the feed by converting higher boiling materials to lower boiling materials. In general, such feed contains at least 25 volume percent of materials boiling above about 850° F., which are derived from a wide variety of sources, and the visbreaking operation is designed to produce lower boiling materials from such heavier materials. In attempting to upgrade feeds by a visbreaking operation, the severity of the operation has generally been limited in that attempts to operate visbreaking at higher severities results in unstable products. Moreover, depending on the severity of the visbreaking operation, coking and fouling of equipment may occur during the visbreaking reaction, which further limits the ability to increase the severity of the visbreaking operation. Thus, for a given feedstock, the greatest conversion could be achieved by increasing severity; however, such increase in severity may adversely affect the product quality and/or the rate of coke formation, whereby the ability to increase conversion by increasing severity is limited.

Various schemes have been proposed for increasing the severity of a visbreaking operation. Thus, for example, U.S. Pat. No. 4,454,023 proposes to increase the severity of a visbreaking operation by subjecting heavy product from the operation to a solvent extraction step to produce, as separate fractions, solvent extracted oil, resin and asphaltene, with the resin fraction being recycled to the visbreaking operation to permit an increase in severity. Such an operation uses a conventional deasphalting solvent to produce a product fraction, which is essentially free of asphaltenes. In this operation, in general, about 40% or more of the feed to the deasphalting is recovered as asphaltenes.

In accordance with the present invention, there is provided a procedure for upgrading heavy viscous materials by a visbreaking operation by treating product from the visbreaking to separate components which adversely affect product stability, without removing all of the asphaltenes. Applicant has found that the stability of product from a visbreaking operation can be increased by removing certain materials from the product, without the necessity of removing all of the asphaltenes, whereby the severity of a visbreaking operation may be increased.

Applicant has further found that if coking and fouling is a problem during the visbreaking operation when operating at a desired higher severity, a portion of the treated product may be recycled to the visbreaking operation in an amount to reduce and/or eliminate the risk of coking and/or fouling during the operation.

More particularly, in accordance with one aspect of the present invention, a heavy viscous material is upgraded by a visbreaking operation (either thermal or hydro-visbreaking) at a severity such that the visbreaking product has a Shell Hot Filtration number of greater than 0.25 (preferably at least 0.3), followed by treating of the product to separate a heavier fraction therefrom and to provide a treated or remaining product having a Shell Hot Filtration number of less than 0.25 (preferably less than 0.15), with the separated heavier fraction being no greater than 15%, by weight of the 650° F.+ feed to the treating, on a diluent free basis, and preferably not greater than 10%, (most preferably not greater than 5%), all by weight, of the 650° F.+ feed to the treating, on a diluent free basis. The Shell Hot Filtration number is on the 650° F.+ fraction. The manner of obtaining the Shell Hot Filtration number is reported in hereinafter Example 1 and the Shell Hot Filtration number is a weight percent.

More particularly, applicant has found that it is possible to increase the severity of a visbreaking operation, and to provide a stable product, by treating all or portion of the visbreaking product to separate certain materials from the product or portion thereof, without removing all of the asphaltenes. By increasing severity and by removing only certain materials, rather than all of the asphaltenes, overall yields are increased. Thus, the severity of the visbreaking operation is increased so that the visbreaking product has a Shell Hot Filtration number in excess of 0.25, followed by treating of all or a portion of the product to remove heavier components to thereby reduce the Shell Hot Filtration number to a value of less than 0.25, with the removed heavier components being no greater than 15 weight percent of the diluent free feed to the treating, whereby unstable components are separated from the visbreaking product, without the necessity of removing all of the asphaltenes.

The manner in which the visbreaking product is treated to provide a treated product having a Shell Hot Filtration number is dependent upon the product which is produced in the visbreaking operation, which, in part, is dependent upon the feed material to the visbreaking. Thus, the treatment is directed toward removing materials which form a separate phase in the reaction product, which separate phase is heavier (higher specific gravity) than the main product phase.

In some cases, it may be possible to treat the product so as to provide a Shell Hot Filtration number, as hereinabove described, by physically separating a heavier separate phase from the reaction product by techniques such as centrifugation, filtration, gravity settling, etc., with centrifuging being particularly preferred.

In other cases, in order to provide a Shell Hot Filtration number, as hereinabove described, it may be necessary to enhance the separate of a separate heavier phase by use of a promoter liquid or anti-solvent so as to reduce the solubility of the components which adversely affect product stability, followed by physical separation of such components from the product or product portion to provide a Shell Hot Filtration number, as hereinabove described.

In still another case, it may be necessary to add a diluent liquid, which does not significantly increase or decrease the solubility of the components which form a separate phase in the reaction product, with the diluent liquid functioning to reduce the viscosity of the product to a value which permits physical separation of unstable components at the required operating conditions.

In accordance with a particularly preferred embodiment, the Shell Hot Filtration number is reduced to a value as hereinabove described by centrifugation of all or a portion of the visbreaking product, with or without the addition of a liquid, which functions as a diluent and/or anti-solvent.

As hereinabove indicated, all or a portion of the visbreaking product may be treated so as to reduce the Shell Hot Filtration number to a value as hereinabove described. Thus, for example, the entire effluent from the visbreaker may be treated, or in the alternative, as known in the art, the effluent from the visbreaker may be introduced into a flash zone and/or distillation zone and/or a combination of a flash zone and distillation zone to remove lighter materials, such as gas oil and lighter components, from the product, with the remaining heavier portion of the product then being treated to reduce the Shell Hot Filtration number. Thus, the materials which create an unstable product are primarily present in the higher boiling portion of the visbreaking product, whereby the visbreaking product, either prior or subsequent to removal of lower boiling materials, may be subjected to treatment to reduce the Shell Hot Filtration number.

The visbreaking product or portion thereof is generally treated at a temperature of from 200° F. to 700° F., and preferably from 300° F. to 700° F. for the purpose of reducing the Shell Hot Filtration number. In addition, the viscosity of the product or portion thereof which is to be treated must be at a value which permits separation of a heavier phase from the treated product or product portion in the separation equipment. The viscosity of the product during treatment is determined, in part, by the method which is used for physically separating the two phases. In general, the viscosity in the treating equipment is in the order of from 50 centistokes to 0.1 centistokes, at the treating temperature. The treating pressure may be in the order of from atmospheric pressure to 200 psig.

As should be apparent, in the case where a centrifuge is used, as in the preferred embodiment, the viscosity of the product introduced into the centrifuge must be at a value such as to permit proper operation of the centrifuge at the treatment temperature. As should be apparent, viscosity increases with a decrease in the treatment temperature, whereby, depending upon the temperature of operation, it may not be necessary to add a diluting liquid to reduce viscosity at the treatment temperature. In some cases, the liquid which is added may, in addition to reducing viscosity, function as an anti-solvent, as hereinabove described or as a cutter stock for use of the produce as a fuel oil.

As hereinabove described, in order to reduce the Shell Hot Filtration number to a value, as hereinabove described, it may be necessary to use an anti-solvent to provide controlled rejection of additional components. In particular, the anti-solvent provides for reducing the solubility of components which adversely affect product stability to reduce the Shell Hot Filtration number. The anti-solvent employed as well as the amount thereof is such that no more than 15%, by weight, of the diluent or solvent free feed to the treating is removed from the feed to the treating as heavier components.

Liquids used as anti-solvents, in the case of the use of a hydrocarbon liquid, have a Watson characterization factor which characterizes such liquids as being more aliphatic than aromatic, with the Watson characterization factor generally being from 9–12. The liquid may be comprised of one or more components; e.g., the promoter liquid may be a cycle oil or a gas oil (350°–650° F.). It is to be understood, however, that liquids other than hydrocarbons may be employed for anti-solvent properties, provided that such liquids provide a controlled insolubilization of material as hereinabove described.

Thus, as should be apparent, the visbreaking product or product portion is treated in a manner so as to reduce the Shell Hot Filtration number to values as hereinabove described, after a visbreaking operation which is operated at a severity which produces a visbreaking product having a Shell Hot Filtration number in excess of 0.25. Moreover, such treatment is effected in a manner which prevents rejection of all of the asphaltenes present in the product in that applicant has found that it is possible to provide a stable visbreaking product, which is produced at a high severity, without rejecting all asphaltenes.

In the case where the visbreaking operation is operated at a severity such that there tends to be coking and/or fouling, in accordance with the present invention, the high severity may be maintained, without adverse fouling and/or coking, by recycling a portion of the treated product to the visbreaking operation. The product or product portion is treated as hereinabove described to provide a stable visbreaking product, and a portion of such stabilized visbreaking product is then recycled to the visbreaking operation to reduce and/or eliminate adverse coking and/or fouling.

The feeds which are subjected to a visbreaking operation are feeds which are heavy and viscous, and which may be obtained from a wide variety of sources, such as petroleum sources; bitumens from tar sands, materials derived from coal sources such as coals, lignite, peat; materials derived from oil shale; materials derived from a wide variety of petroleum sources such as residuums resulting from atmospheric and/or vacuum distillation of crude oil, heavy residues from solvent extraction processes, and the like. Such materials are generally comprised of a mixture of a hydrcarbons, and are characterized by an API gravity of less than 20 degrees. Such feeds are generally known in the art, and no further details in this respect are deemed necessary for a complete understanding of the present invention.

In accordance with the present invention, a feed is subjected to visbreaking at a high severity to produce a product having a Shell Hot Filtration number in excess of 0.25. In general, the visbreaking (whether thermal visbreaking or hydrovisbreaking) is operated at a temperature of from 700° F. to 1000° F., and a pressure of from 25 to 2000 psig. The severity of the operation is generally sufficient to convert from 4% to 25%, by weight, of the fressh feed to 350° F.− material. Depending of the feedstock it is to be understood that higher or lower severities may be obtained within the spirit and scope of the invention.

The equipment which is employed for visbreaking may be of a type known in the art; for example, a coil, or coil plus soaking drum, etc. As hereinabove indicated, the visbreaking may be effected thermally, or may by a hydrovisbreaking operation, in which case, gaseous hydrogen or a donor liquid is added to the feed material.

The product from the visbreaking may then either be directly treated to reduce the Shell Hot Filtration number, or, preferably, as hereinabove described, the product is subjected to a distillation operation to separate lighter materials, with the remaining heavier materials then being subjected to treatment, as hereinabove described, to remove an insoluble heavy phase and reduce the Shell Hot Filtration number.

BRIEF DESCRIPTION OF THE DRAWING

The invention will be further described with respect to the following drawing, wherein:

The drawing is a simplified schematic flow diagram of an embodiment of the present invention.

Referring now to the drawing, a viscous feed, which is to be subjected to visbreaking, in line 10, is combined with recycle, if any, in line 11, and the combined feed in line 12 is introduced into a visbreaking unit, schematically generally indicated as 13.

The visbreaking unit 13 may be of a type known in the art and may be comprised of a coil, or preferably a coil plus soaking drum. The visbreaker is operated to provide a high severity operation wherein the product recovered from the visbreaker 13, in line 14 has a Shell Hot Filtration number in excess of 0.25, and is preferably in excess of 0.3. The Shell Hot Filtration number is determined on the basis of 650° F.+ material in the product.

The product in line 14 is introduced into a separation zone, schematically shown as 15, which may contain one or more columns and/or other types of separation devices. In the separation zone 15, the visbreaking product is separated to recover, preferably as separate fractions, a C4-gas, a C5 to 350° F. gasoline fraction, and a 350° to 650° gas oil fraction. Depending upon the products desired, the separation zone 15 may be operated to recover a 650° F.+ fraction, which is then treated in accordance with the present invention, or alternatively, the separation zone 15 may be operated to recover a heavier gas oil fraction which boils from 650° to 900° F., and a heavier fraction, which is a 900° F. plus fraction, which is then treated in accordance with the present invention.

The heavy fraction recovered from separation zone 15 through line 16, as hereinabove noted, may be either a 650° F.+ fraction, or a 900° F.+ fraction. It is to be understood, however, that the heavier fraction recovered through line 16 may or may not include all of the components which boil above 650° F. Thus, for example, it is possible to recover a 750° F.+ fraction and/or a 950° F.+ fraction through line 16.

The heavy fraction in line 16 is introduced into a treating zone, schematically generally indicated as 17 to separate heavier components therefrom and to reduce the Shell Hot Filtration number to values as hereinabove described, without removing more than 15% percent, by weight of the materials introduced into the treating zone 17 through line 16.

Depending upon the characteristics of the material in line 16, which is depending upon the feed in line 10, as well as the specific conditions for visbreaking, it may or may not be necessary to add additional components to the treating zone 17 to enable removal of heavier components, as hereinabove described, and thereby reduce the Shell Hot Filtration number and increase without removing all of the asphaltenes.

Thus, for example, in one embodiment the heavier material in line 16 is treated in treating zone 17 to recover heavier components through line 18 and provide a remaining product in line 19, without adding an extraneous material to the treating zone 17. In such an embodiment, the remaining product in line 19, may be mixed with a cutter stock in line 21, as known in the art, to provide a fuel oil product in line 22.

In another embodiment, the cutter stock for providing a fuel oil mixture may be added to the treating zone 17 through line 23, with such cutter stock functioning as a diluent to reduce viscosity to a value effective for the treatment in treating zone 17. Alternatively, a diluent other than a cutter stock may be employed in line 23.

As a further embodiment, it may be necessary to employ an antisolvent in order to reduce the Shell Hot Filtration number, as hereinabove described, without removing more than 15 weight percent of the undiluted feed to the treating zone, as heavier components through line 18. In such an embodiment, anti-solvent in line 24, which is comprised of fresh feed antisolvent in line 25 and recycle antisolvent in line 26 is introduced into the treating zone 17 for reducing the solubility of a portion of the components introduced through line 16 to reduce the Shell Hot Filtration number without removing more than 15 weight percent of the feed introduced through line 16. In such an embodiment, a mixture of the remaining product and antisolvent is recovered from treating zone 17 through line 19, and the mixture is introduced through line 27 into a solvent recovery zone, schematically generally indicated as 28. In the solvent recovery zone 28, solvent is recovered through line 26 for recycle, and remaining product is recovered through line 29, which may be diluted with cutter stock in line 21 for subsequent use as a fuel oil in line 22.

The treating zone 17 is preferably comprised of one or more centrifuges for effecting separation of the heavy components; however, as hereinabove described, other separating devices may be employed.

As hereinabove described, in some cases, when operating at a high severity, it may be necessary to employ a portion of the treated product, as recycle to the visbreaker in order to reduce and/or eliminate fouling or coking which may occur at such severities. As shown in the drawing, a portion of the treated product may be recycled to the visbreaker through line 11. As should be apparent, the treated product portion, which is recycled through line 11, may be obtained by treatment with or without an antisolvent and/or with or without use of an appropriate diluent.

Thus, as should be apparent, in accordance with the preferred embodiment, a heavy fraction recovered from the visbreaking, which boils above 650° F., and which may be comprised of all or a portion of the components which boil above 650° F. is treated with or without a diluent or with or without an antisolvent to reduce the Shell Hot Filtration number to values as hereinabove described, without removing all of the asphaltenes. In particular, in the treating to reduce the Shell Hot Filtration number no more than 15 weight percent, preferably no more than 10 weight percent, and most preferably no more than 5 weight percent of the diluent free heavy material subjected to treatment is separated from the product, as a heavier phase.

Although the invention has been described with respect to specific embodiments shown in the drawing, it is to be understood that the scope of the invention is not to be limited thereby. Thus, for example, although in the preferred embodiment, the visbreaking product is separated into various fractions, prior to treatment, it is possible to treat the entire visbreaking product, prior to such separation. As should be apparent, such an embodiment is less preferred in that it would necessitate treating higher volumes of material. As a further modification, in the case where the visbreaking product is unstable in the lines and/or equipment prior to the distillation, a portion of the treated product may be recycled for mixing with the visbreaking product, prior to the separation operation to improve stability.

It is also to be understood that various portions of the overall system have not been described in detail; however, such portions are deemed to be within the scope of those skilled in the art from the teaching herein. Thus, for example, the visbreaking effluent, prior to separation, may be cooled by a direct quench operation by using heavier material from the separation zone and/or a portion of the treated product.

Although in accordance with a preferred embodiment, the visbreaking product is employed for making a fuel oil, it is to be understood that other uses are also within the spirit and scope of the present invention.

The present invention will be further described with respect to the following examples; however, the scope of the invention is not to be limited thereby:

EXAMPLE 1 - SHELL HOT FILTRATION TEST

This test is reported in J. Inst. Petroleum Vol. 37, No. 334 P. 596–604, and the apparatus for performing the test is shown therein.

Apparatus

1. Pressure filter
2. ⅛" Hard felt disc.
3. Whatman No. 50 filter paper, 7 cm. ia.
4. 2–1000 ml. Erlenmeyr filtering flasks.
5. n-Heptane, Industrial Grade.
6. 1000 mm Open end Mercury Manometer.
7. Pour point test jar. or 4 oz. oil sample bottle.
8. 20 ml. graduate.
9. 250 ml. graduate.
10. Oil bath.
11. 10 ml. pipette.
12. 25 ml. graduate.

Procedure

1. Place 50 gms of sample in pour test jar and suspend in oil bath held at 212° F. for 24 hours. (This step to be disregarded when testing material on an "as-received" basis.)

2. Dry filter paper in oven at 220° F. for ½ hour. Store papers in a dessicator, no dissicant, for 1 hour. Weigh to 4th place.

3. Remove steam jacket from filter and place felt disc on perforated plate. Flat part of plate goes down. Place weighed filter paper on felt and connect vaccuum. Apply enough vacuum, approx. 30 mm Hg., to hold down paper. Attach steam jacket, inlet on top.

4. Shut off vacuum and pass steam through jacket, make sure jacket is hot. Weigh an empty 30 ml. beaker and add approximately 10.3 gms of sample. This will be the gross weight. The additional 0.3 gms of sample is for stickage in beaker after pouring sample onto filter pad.

5. Pour 10.0±0.1 gms of sample (held at approximately 210° F.) on filter paper, ensuring that no sample runs off filter shell wall.

6. Attach filter top tighten top 4 nuts and slowly apply nitrogen to filter shell, increasing pressure in 2 lb. increments to 15–20–30–40 psig until filtration starts. Amount of pressure required is dependent on density of sample. Complete filtration should take 5–10 minutes for sample to pass through.

7. Now re-weigh beaker plus stickage to get tare weight. Subtract this weight from the previous gross weight to get net weight of sample used for the filtration test.

8. When filtration is complete, indicated by passage of nitrogen through filter and vacuum control bleed line, decrease or increase amount of $N_2$ to 20 psig for additional 5 minutes until there is negligible drippage of sample through filter paper and felt pad. Turn off $N_2$ and vacuum and remove filter top.

9. If cake or paper is dry, shut off and detach steam inlet and hook-up to cooling water for 10 minutes. Water inlet can be at top or bottom.

10. When filter is cool, wash wall and cake with 2–10 ml washings of n-heptane using 10 ml pipette and then with 9–20 ml washings using 25 ml graduate (apply enough vacuum to maintain a steady drip) approx. 80–100 mm Hg. or until filtrate is clear. To suction off remaining n-heptane retained in felt pad after each 20 ml wash, it is advisable to apply approximately 300 mm. Hg. vacuum or blocking off vac. bleed line with the thumb for 10 seconds. Lighter gravity material will require 200 ml minimum of wash and 300 ml maximum for heavier gravity material. After final 20 ml wash, apply maximum vacuum for 1 minute.

11. Remove vacuum and steam jacket. Any oil present on paper where jacket rim rested on paper should be washed away with n-heptane. Leave paper on pad with maximum vacuum and wash outer edge of paper with 10 ml n-heptane using eye-dropper. Be careful to wash edge of paper so that n-heptane will flow toward recessed groove of filter paper.

12. Remove paper and dry in oven at 220° F. for ½ hour and cool in dessicator (no dessicant) for 1 hour.

Calculation and Report 13. a. Calculate the Shell Hot Filtration Number of the sample as follows:

$$\text{Shell Hot Filtration Number} = \frac{A(100)}{W}$$

A = weight of dry sludge, grams

W = weight of sample, grams.

Precision

14. Repeatability

Duplicate results by the same operator should not be considered suspect unless they differ by more than 0.03 weight percent absolute.

The present invention is particularly advantageous in that the visbreaker may be operated at higher severities, without the disadvantages heretofore encountered in the art; for example, an unstable heavier product and/or severe fouling and coking of equipment. By operating at a higher severity, the yield of lighter products is increased.

Moreover, in treating the heavier portion of the product in accordance with the present invention, as compared to prior art deasphalting techniques, the desired stability is obtained, while increasing the yield of 650° F.+ material, which may be employed, for example, as a stable fuel oil.

These and others advantages should be apparent to those skilled in the art of the teachings herein.

In the present specification, and in the claims, in describing the characteristics of the visbreaking product prior to treatment, as well as the characteristics of the treated product, with respect to the Shell Hot Filtration Number, it is to be understood that actual measurement of the Shell Hot Filtration number, as part of the processing parameters, is not necessary to bring a process within the scope of the appended claims in that the Shell Hot Filtration number defines a characteristic of the feed or product.

Numerous modifications and variations of the present invention are possible in light of the above teachings and, therefore, within the scope of the appended claims, the invention may be practiced otherwise than as particularly described.

What is claimed:

1. A process for upgrading a viscous feed, comprising:

subjecting a viscous feed to visbreaking at a severity to produce a visbreaking product having a Shell Hot Filtration number of greater than 0.25; and treating at least a portion of the visbreaking product to separate a heavy phase containing an asphaltene portion, said heavy phase being separated in an amount no greater than 15% by weight, of a 650° F.+ fraction of said at least a portion of the visbreaking product said treating providing a remaining product have a Shell Hot Filtration number of less than 0.25.

2. The process of claim 1 wherein a portion of the visbreaking product which boils above 650° F. is subjected to said treating to provide a Shell Hot Filtration number of less than 0.25.

3. The process of claim 2 wherein said treating comprises centrifugation to separate a heavier phase from remaining product.

4. The process of claim 3 wherein the heavy phase is separated in an amount no greater than 5%, by weight, of the 650° F.+ fraction of the visbreaking product subjected to the treating.

5. The process of claim 1 wherein said treating includes the addition of an antisolvent.

6. The process of claim 1 wherein said treating includes the addition of a diluent.

7. The process of claim 1 wherein the heavy phase is separated in an amount no greater than 5%, by weight, of the 650° F.+ fraction of the visbreaking product subjected to the treating.

8. The process of claim 7 wherein the remaining product has a Shell Hot Filtration number of less than 0.15.

9. The process of claim 1 wherein the treating is effected at a temperature of from 200° F. to 700° F.

10. The process of claim 1 wherein the visbreaking is effected at a severity to convert from 4% to 25%, by weight, of the viscous feed to 350° F.-material.

11. The process of claim 3 wherein the treating is effected at a temperature of from 200° F. to 700° F.

12. The process of claim 11 wherein the visbreaking is effected at a severity to convert from 4% to 25%, by weight, of the viscous feed to 350° F.− material.

13. The process of claim 8 wherein the visbreaking is effected at a severity to convert from 4% to 25%, by weight, of the viscous feed to 350° F.− material.

14. The process of claim 1 wherein said remaining product is suitable for blending with a cutter stock for use as a fuel oil.

15. A process for upgrading a viscous feed, comprising:

subjecting a viscous feed to visbreaking at a severity to produce a visbreaking product having a Shell Hot Filtration number of greater than 0.25; and treating at least a portion of the visbreaking product to separate a heavy phase containing an asphaltene portion, said heavy phase being separated in an amount no greater than 15%, by weight, of a 650° F.+ fraction of said at least a portion of the visbreaking product said treating providing a remaining product having a Shell Hot Filtration number of less than 0.25; and recycling a portion of the remaining product to the visbreaking to reduce coking and fouling.

16. The process of claim 15 wherein said treating comprises centrifugation to separate a heavier phase from remaining product.

17. The process of claim 15 wherein the visbreaking is effected at a severity to convert from 4% to 25%, by weight of the viscous feed to 350° F.− material.

18. The process of claim 15 wherein the heavy phase is physically separated from the remaining product.

19. The process of claim 17 wherein the heavy phase is separated in an amount no greater than 5%, by weight, of the 650° F.+ fraction of the visbreaking product subjected to the treating.

20. The process of claim 19 wherein the remaining product has a Shell Hot Filtration number of less than 0.15.

21. The process of claim 15 wherein said treating includes the addition of a diluent.

22. The process of claim 15 wherein said remaining product is suitable for blending with a cutter stock for use as a fuel oil.

* * * * *